US012276478B2

(12) United States Patent
McGee et al.

(10) Patent No.: US 12,276,478 B2
(45) Date of Patent: Apr. 15, 2025

(54) FIREARM HOLSTER

(71) Applicant: Mission First Tactical, LLC, Horsham, PA (US)

(72) Inventors: Bobby McGee, Horsham, PA (US); Christopher Pettit, Horsham, PA (US)

(73) Assignee: Mission First Tactical, LLC, Horsham, PA (US)

( * ) Notice: Subject to any disclaimer, the term of this patent is extended or adjusted under 35 U.S.C. 154(b) by 40 days.

(21) Appl. No.: 17/983,072

(22) Filed: Nov. 8, 2022

(65) Prior Publication Data

US 2024/0151496 A1 May 9, 2024

(51) Int. Cl.
*F41C 33/04* (2006.01)
*F41C 33/02* (2006.01)

(52) U.S. Cl.
CPC ..... *F41C 33/0209* (2013.01); *F41C 33/0254* (2013.01); *F41C 33/041* (2013.01); *F41C 33/048* (2013.01)

(58) Field of Classification Search
CPC ..... F41C 33/0209; F41C 33/048; F41C 33/0236; F41C 33/0254; F41C 27/00; F41C 33/041; F41C 33/045; F41C 33/043; A45F 2200/0591; A45F 5/021; Y10S 224/912; Y10S 224/911
See application file for complete search history.

(56) References Cited

U.S. PATENT DOCUMENTS 5,167,355 A * 12/1992 Hill ..... A45F 5/00 403/97
5,282,559 A * 2/1994 Wisser ..... F41C 33/045 224/193
8,653,974 B2 * 2/2014 Crook ..... G08B 25/10 340/568.1
11,408,709 B2 * 8/2022 DeSantis ..... F41C 33/0209
(Continued)

FOREIGN PATENT DOCUMENTS

CN 213811956 U 7/2021

OTHER PUBLICATIONS

International Bureau of WIPO, International Search Report and Written Opinion received for Application No. PCT/US2023/019157, mailed Jul. 26, 2023.
(Continued)

*Primary Examiner* — Adam J Waggenspack
(74) *Attorney, Agent, or Firm* — SNELL & WILMER L.L.P.

(57) ABSTRACT

A firearm holster has an outer wall, extending between a muzzle end and a breech end, defining a cavity configured to receive a firearm. A magnet and/or magnet assembly may be included, wherein the magnet is at least partly in the cavity at the muzzle end. The magnet assembly is coupled to the muzzle end and includes a magnet housing coupled to the outer wall and connected to the magnet. The holster may include a protruding wedge on a side panel of the outer wall, wherein the protruding wedge comprises a surface formed at an angle from the longitudinal holster axis. The wedge
(Continued)

presses against a user's body to help alleviate the holster sagging. The holster may also have a spacer assembly, a portion of which can be configured to press against a user's body to achieve a desired resting angle of the holster.

20 Claims, 10 Drawing Sheets

(56) References Cited

U.S. PATENT DOCUMENTS

| | | | | |
|---|---|---|---|---|
| 2006/0175365 | A1* | 8/2006 | Sandler | A45F 3/14 224/265 |
| 2008/0110947 | A1 | 5/2008 | Pikielny | |
| 2009/0071992 | A1* | 3/2009 | Franz | B62J 11/00 224/420 |
| 2011/0266317 | A1 | 11/2011 | Clifton | |
| 2015/0369559 | A1 | 12/2015 | Del Rosario | |
| 2018/0142988 | A1 | 5/2018 | Tedder et al. | |
| 2018/0274281 | A1 | 9/2018 | Bernkrant et al. | |
| 2019/0128640 | A1 | 5/2019 | Shinkle | |
| 2019/0257617 | A1* | 8/2019 | Sereday | F41C 33/0209 |
| 2022/0155042 | A1 | 5/2022 | Considine et al. | |
| 2024/0142197 | A1* | 5/2024 | Kirsch | F41C 33/0245 |

OTHER PUBLICATIONS

PCT; International Search Report and Written Opinion received for Application No. PCT/US2024/031678, mailed Oct. 31, 2024.

* cited by examiner

FIREARM HOLSTER

BACKGROUND

Firearm holsters come in various configurations depending on the needs of the user and the firearm used. Some holsters are designed for firearms comprising rail attachments (e.g., a semiautomatic pistol having a light attached to the rail under the barrel). However, such holsters can be unsuitable for use with firearms without rail attachments, because the space in the holster and the clearance provided for the rail attachment can cause the firearm without an attachment to rattle or otherwise undesirably shift or move in the holster, or otherwise fail to be stabilized therein. Firearm holsters can also sag on the user's pants or against the user's body, or regarding holsters meant for concealed firearm carry (e.g., inside-waistband holsters), the holster may protrude from the wearer's body causing discomfort for the wearer and/or visibility to third parties (i.e., the firearm may print on the wearer's clothing). Additionally, holsters are known that include a magnet to secure against the trigger guard or the slide of a semi-automatic pistol. These magnetic-grip holsters tend to scratch the firearm over time and, with respect to holsters with magnets that secure a slide, they can cock the slide to its open position.

SUMMARY

A firearm holster has an outer wall defining a cavity configured to receive a firearm. The outer wall has a muzzle end and a breech end. A magnet may be positioned in the muzzle end of the cavity and be configured to magnetically couple to the crown of a firearm muzzle when the firearm is positioned in the cavity. The magnet may be part of a magnet assembly coupled to the muzzle end of the outer wall, wherein the magnet assembly includes a magnet housing coupled to the outer wall and the magnet positioned in the cavity.

The holster may also, or instead, include a protruding wedge on at least one of a first side panel and the second side panel of the outer wall, wherein the protruding wedge comprises a surface formed at an angle from the longitudinal holster axis. The wedge presses against a user's body to help alleviate the holster sagging. The holster may also, or instead, have a spacer adjustment end and a spacer shim configured to press against a body of a user to achieve a desired resting angle of the holster

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures. Elements with like element numbering throughout the figures are intended to be the same.

DETAILED DESCRIPTION

Figure 1:
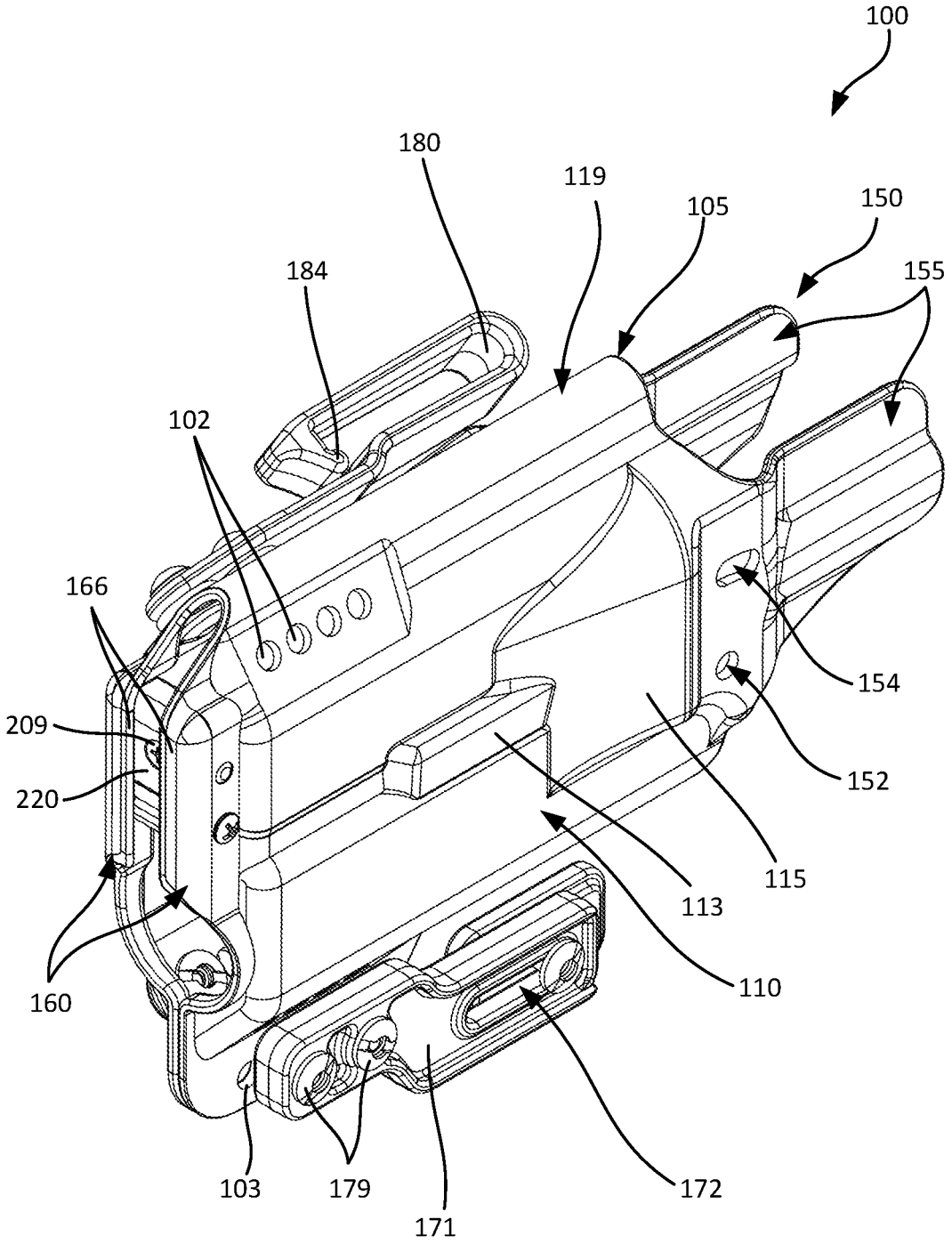
FIG. 1 illustrates a front perspective view of a firearm holster, in accordance with various examples.
Figure 2:
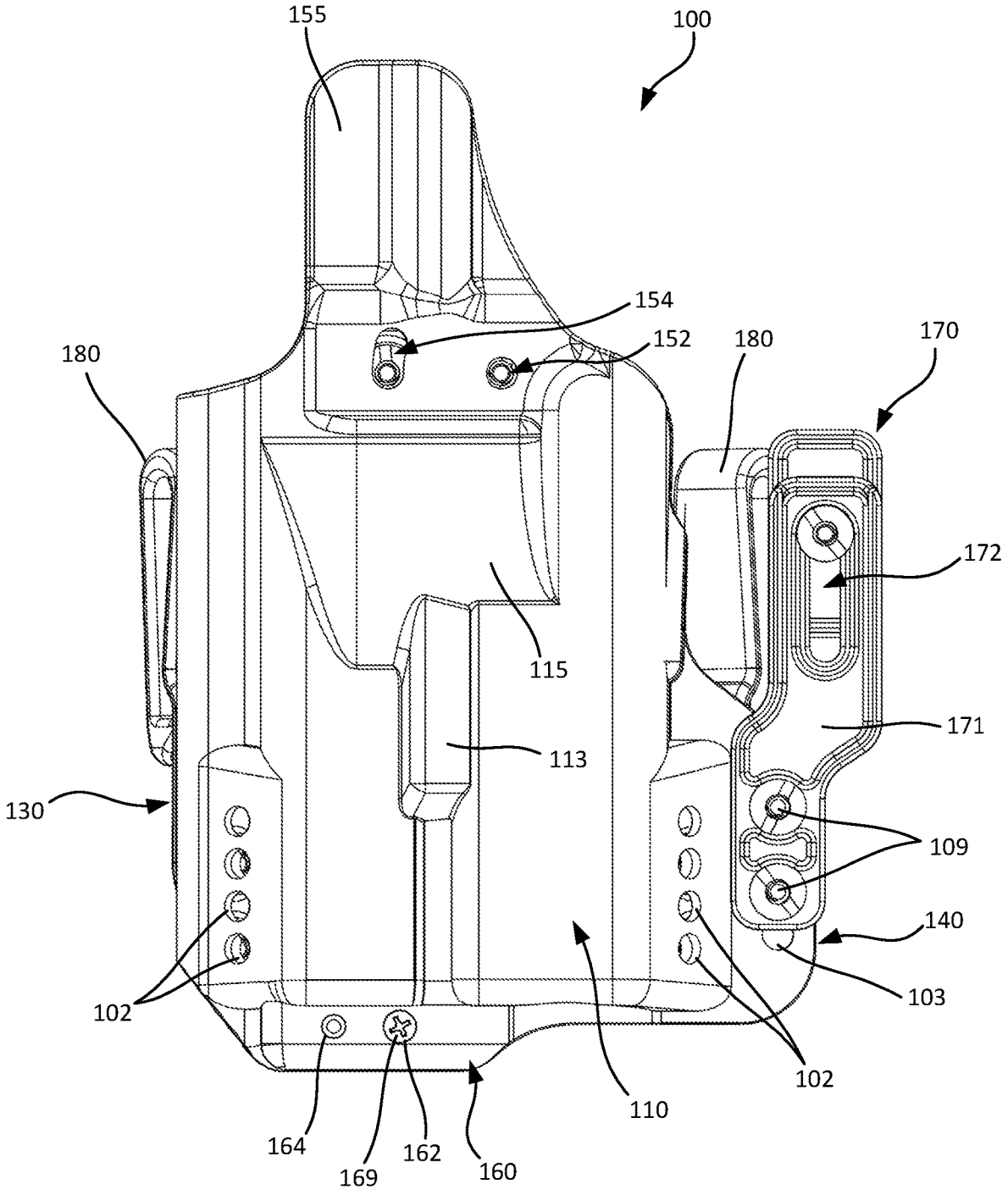
FIG. 2 illustrates a first side view of the firearm holster of FIG. 1, in accordance with various aspects of this disclosure.
Figure 3:
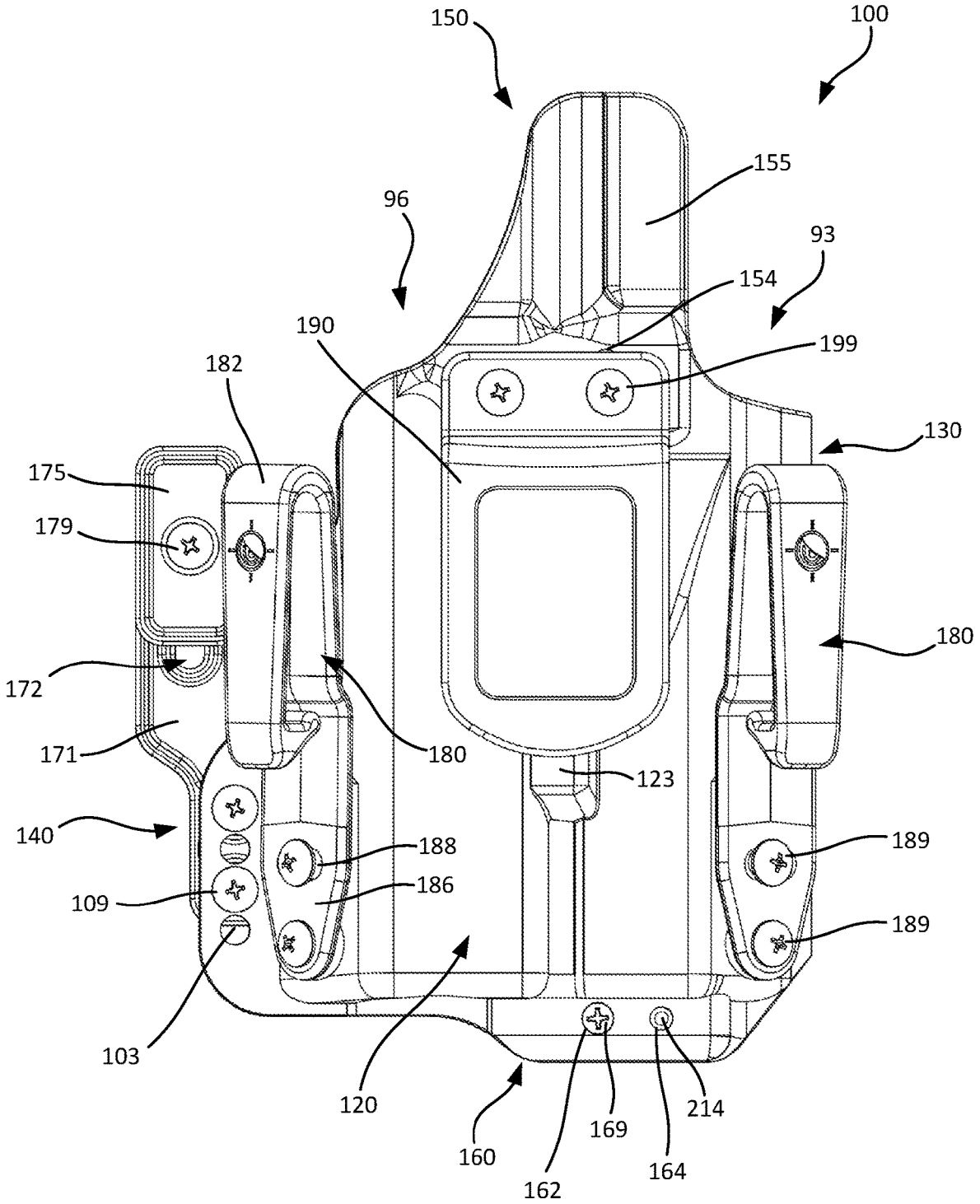
FIG. 3 illustrates a second side view of the firearm holster of FIG. 1.
Figure 4:
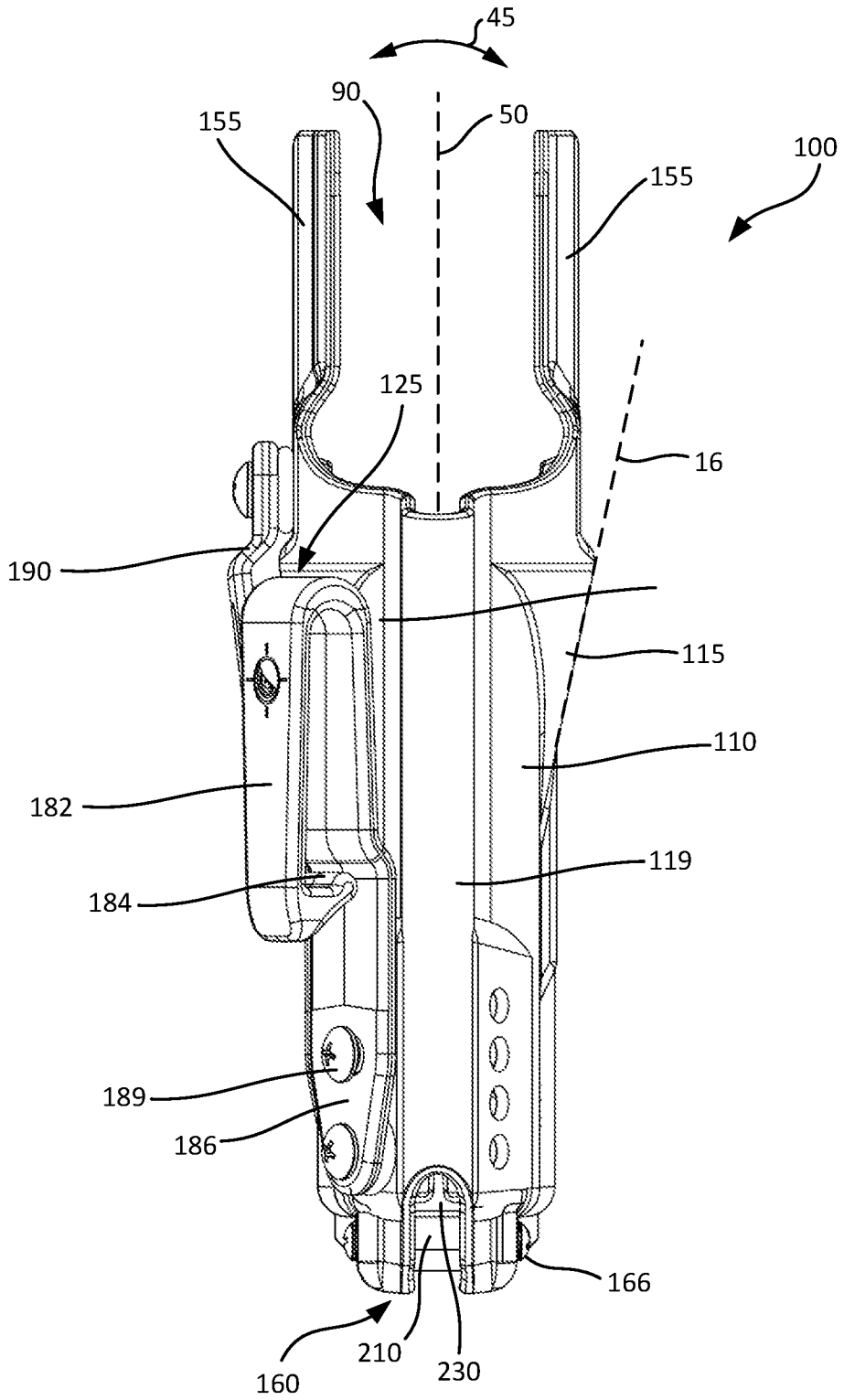
FIG. 4 illustrates a top view of the firearm holster of FIG. 1.
Figure 5:
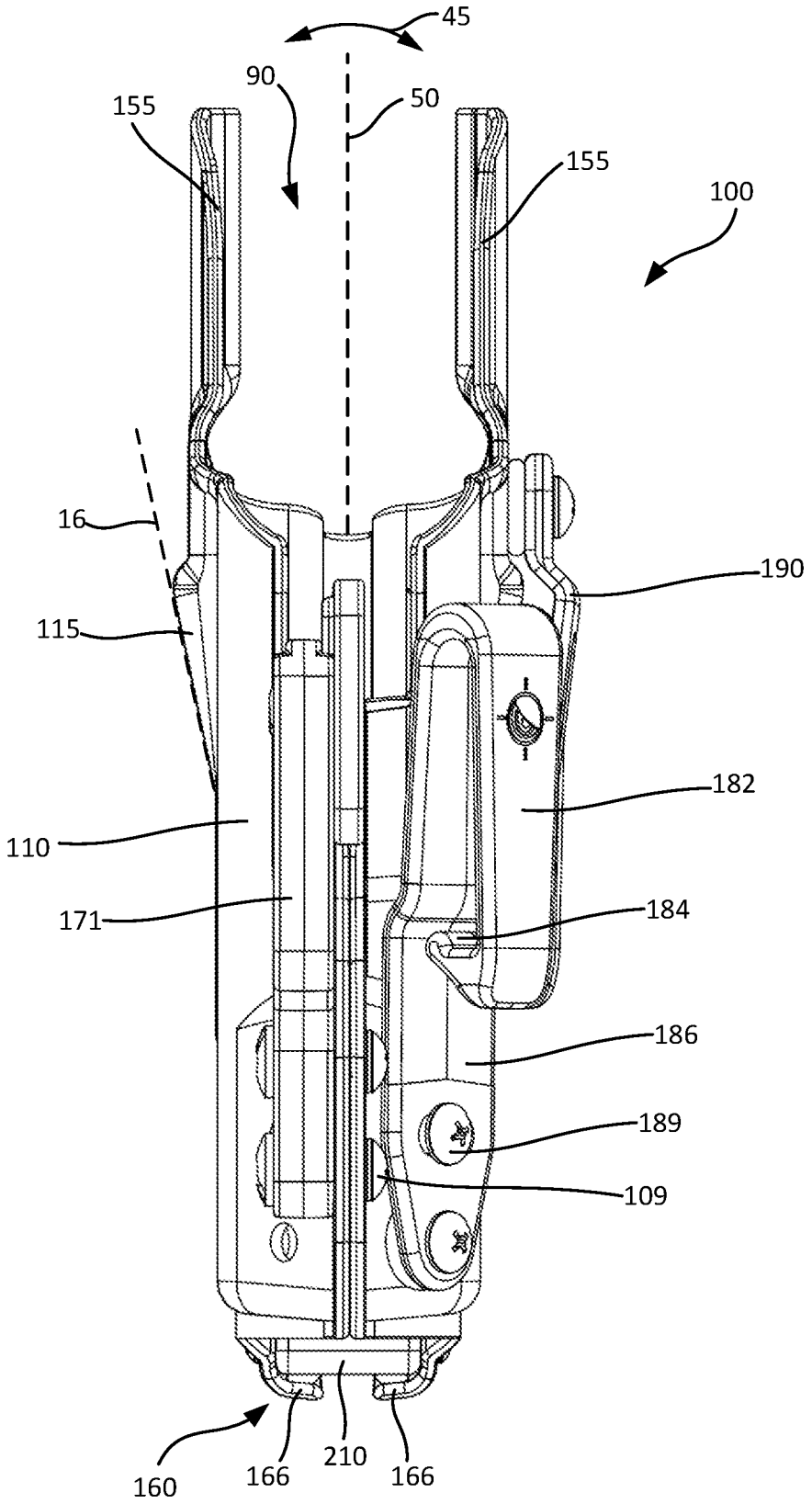
FIG. 5 illustrates a bottom view of the firearm holster of FIG. 1.
Figure 6:
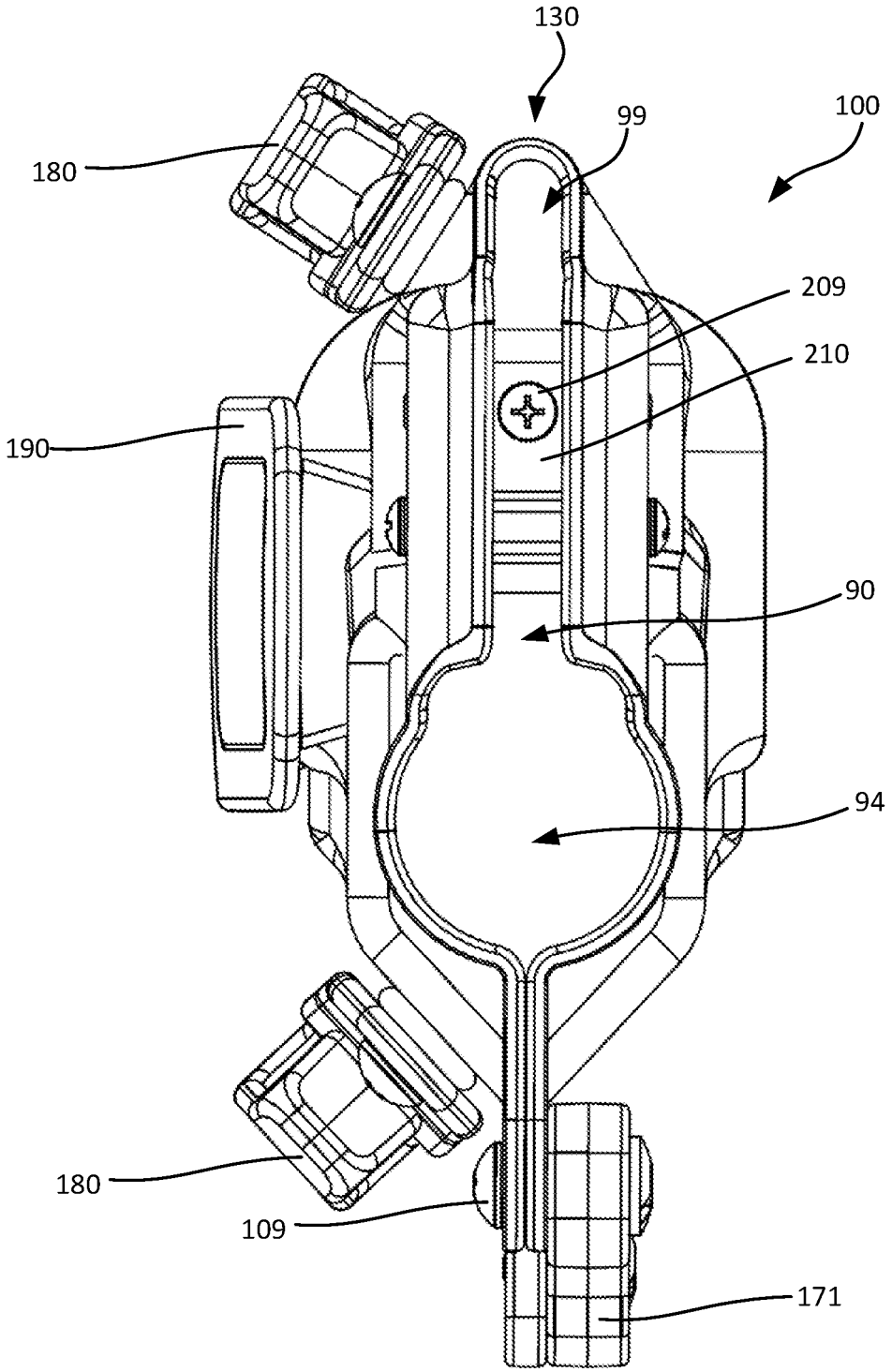
FIG. 6 illustrates a forward or muzzle view of the firearm holster of FIG. 1.
Figure 7:
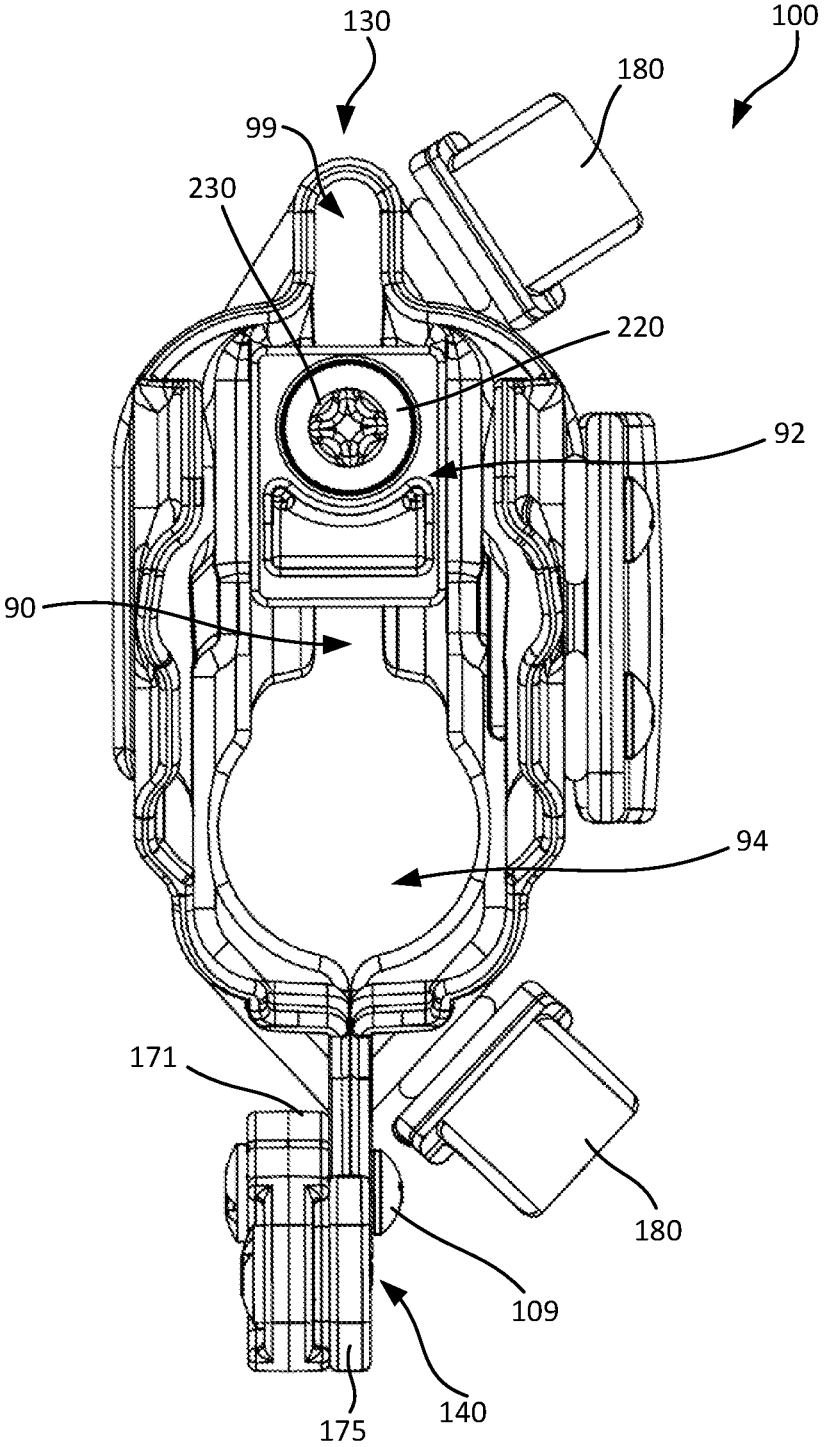
FIG. 7 illustrates a back view of the firearm holster of FIG. 1.

The detailed description of various examples herein refers to the accompanying drawings, which show various examples by way of illustration. While these various examples are described in sufficient detail to enable those skilled in the art to practice the disclosure, other examples may be realized and logical changes may be made without departing from the scope of the disclosure.

As used herein, the term "aft," "back," "rear," or the like refers to the direction associated with a butt (e.g., the back or rear end) of a firearm or the breech of a firearm barrel, or generally, to the direction of recoil in response to firing a round or cartridge in a firearm. As used herein, the term "forward," "front," or the like refers to the direction associated with a muzzle (e.g., the front end) of the firearm or barrel, or generally, to the direction of flight of a projectile (e.g., a bullet) fired from a firearm.

With reference to FIGS. 1-8, a firearm holster 100 extends from a breech end 150 to a muzzle end 160. Muzzle end 160 is configured to house a muzzle of a firearm disposed in holster 100. Breech end 150 is configured to house and/or retain an aft portion of a firearm (e.g., at or aft of the breech). Breech end 150 of holster 100 includes an opening through which a firearm can be inserted into a firearm cavity (or cavity) 90 of holster 100. Holster 100 extends between a top end 130 and a bottom end 140. Top end 130 corresponds to a top of the firearm that will be disposed in cavity 90 of holster 100 (the top of the firearm being the portion of the firearm facing upward when properly held to fire by a right side up user). Bottom end 140 corresponds to a bottom of the firearm that will be disposed in the cavity 90 of holster 100 (the bottom of the firearm being the portion of the firearm facing downward when properly held to fire by a right side up user).

Holster 100 comprises an outer wall 105 defining firearm cavity 90 configured to receive and/or retain a firearm in holster 100. Outer wall (or "outer wall system") 105 comprises a first side panel 110 and a second side panel 120 opposite first side panel 110 across firearm cavity 90. First side panel 110 and second side panel 120 can be separate pieces coupled together, e.g., at top end 130 and bottom end 140. First side panel 110 and second side panel 120 can be one piece of material (e.g., a monolithic or integral piece of material) folded over at one end (e.g., forming bridge portion 119 at top end 130) and coupled together at another end (e.g., bottom end 140) to define firearm cavity 90. For example, first side panel 110 and second side panel 120 can be coupled together at top end 130 or bottom end 140. As shown in FIGS. 1-8, first side panel 110 and second side panel 120 are coupled together at bottom end 140. Each of first side panel 110 and second side panel 120 can comprise coupling apertures 103, which are complementary to one another and align in response to the mating of first side panel 110 and second side panel 120. First side panel 110 and second side panel 120 can be coupled in any suitable manner such as a clasp or other tension device, adhesive, fastener, welding, or other suitable manner. For example, first side panel 110 and second side panel 120 can be coupled by fasteners 109 disposed through coupling apertures 103.

First side panel 110 and second side panel 120 can be similar or identical (e.g., substantially mirror images of each other), such that first side panel 110 and second side panel 120 comprise the same features and/or components. Such a configuration allows holster 100 to be ambidextrous, meaning that the holster can be configured (by its design and/or by switching or moving components from one side panel to another side panel) to be used in a right-hand or left-hand configuration.

First side panel 110 and/or second side panel 120 can comprise guard panels 155 protruding along axis 50 (axis 50 is a holster axis and/or a longitudinal axis). Guard panels 155 can span alongside portions of holster 100 (e.g., corresponding to first side panel 110 and/or second side panel 120), thus being configured to cover the sides of a firearm disposed in cavity 90 of holster 100. The spaces 93, 96 above and/or below guard panels 155 are open, which provides clearance for firearm sights and/or a firearm handle, respectively. For example, top open space 93, above guard panels 155 and aft of bridge 119, can be configured to allow an aft portion of a firearm slide and/or a firearm hammer to be exposed, and/or space for a sight (e.g., a red dot sight, or other mounted optic) coupled to the firearm. Top open space 93 facilitates easier drawing of the firearm from holster 100 and/or lessen or mitigate the risk of moving a portion of the action during holstering or drawing the firearm (e.g., disturbing the slide from battery or bumping/moving the hammer). As another example, bottom open space 96, below guard panels 155, can be configured to allow a handle of a firearm to be exposed. Bottom open space 96 provides more exposed surface of the firearm handle to facilitate easier gripping of the handle and drawing of the firearm from holster 100.

Figure 8:
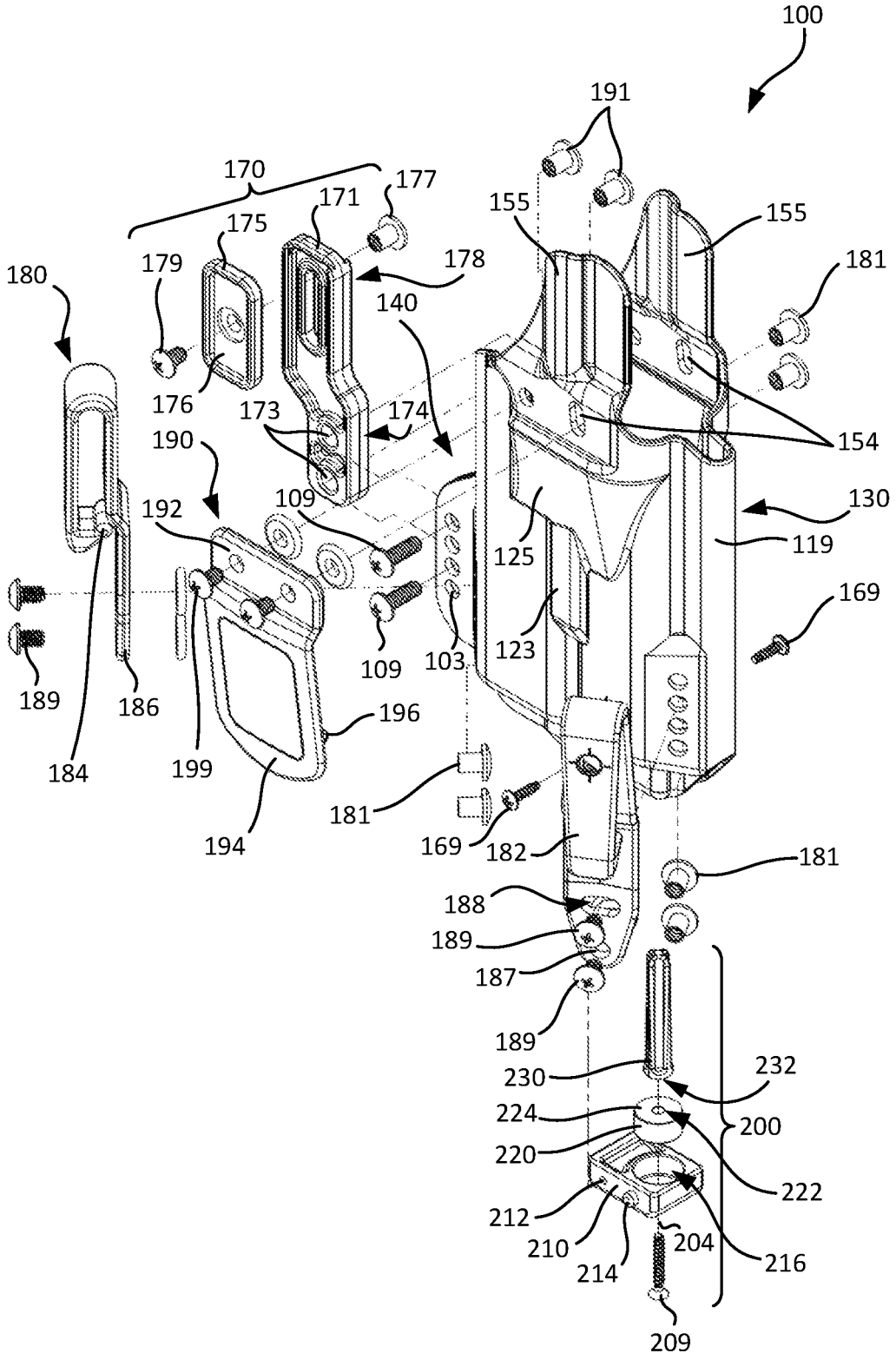
FIG. 8 illustrates an exploded, perspective view of the firearm holster of FIG. 1.
Figure 9:
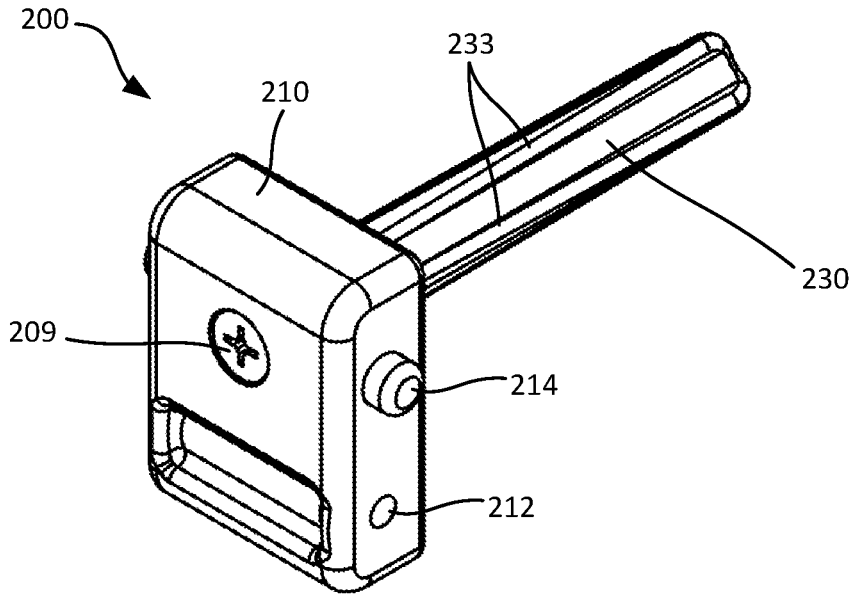
FIG. 9 illustrates a front perspective view of a magnet assembly for the firearm holster of FIG. 1.
Figure 10:
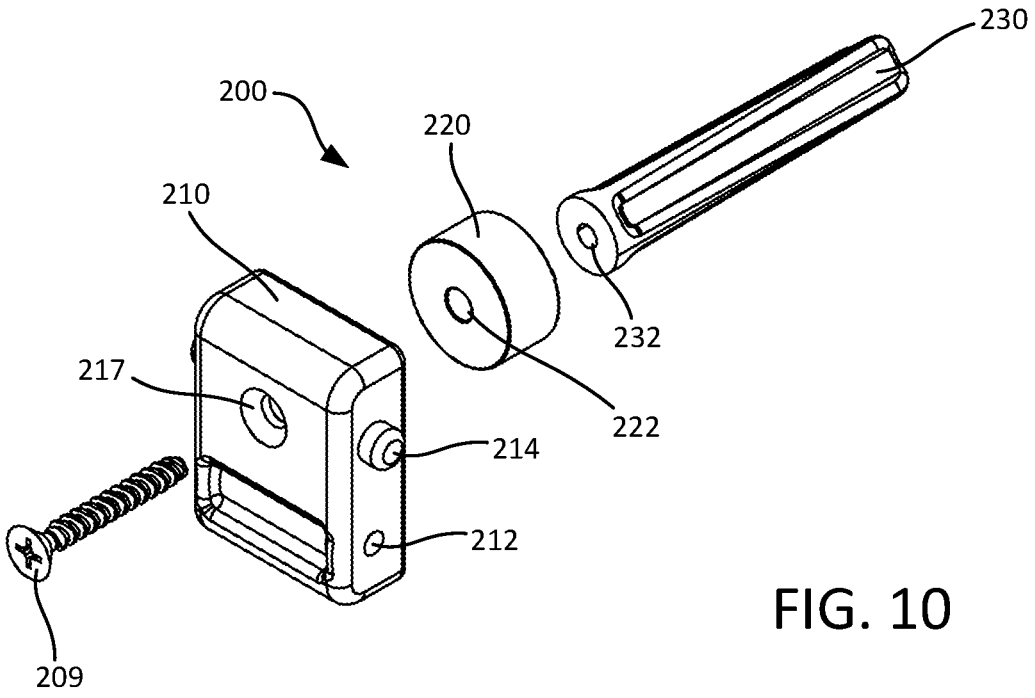
FIG. 10 illustrates an exploded, perspective view of the magnet assembly of FIG. 9.
Figure 11:
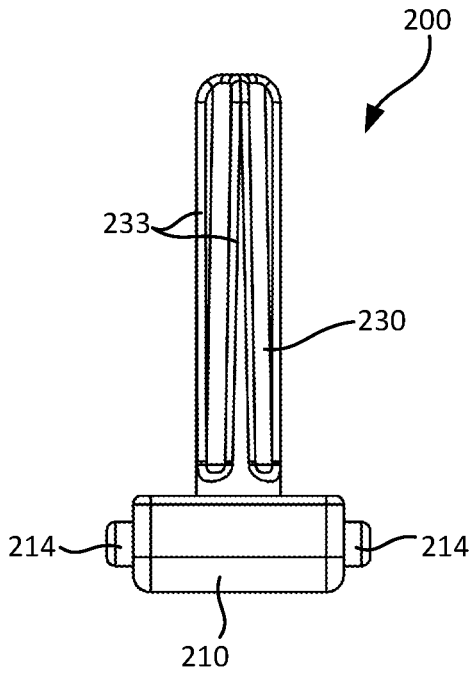
FIG. 11 illustrates a top view of the magnet assembly of FIG. 9.
Figure 12:
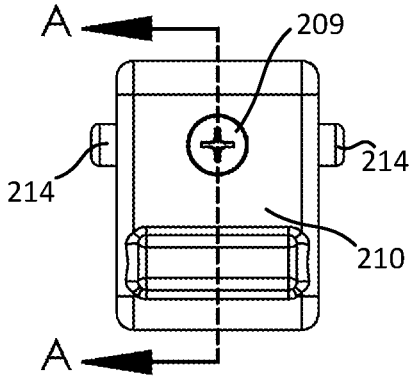
FIG. 12 illustrates a front view of the magnet assembly of FIG. 9.
Figure 13:
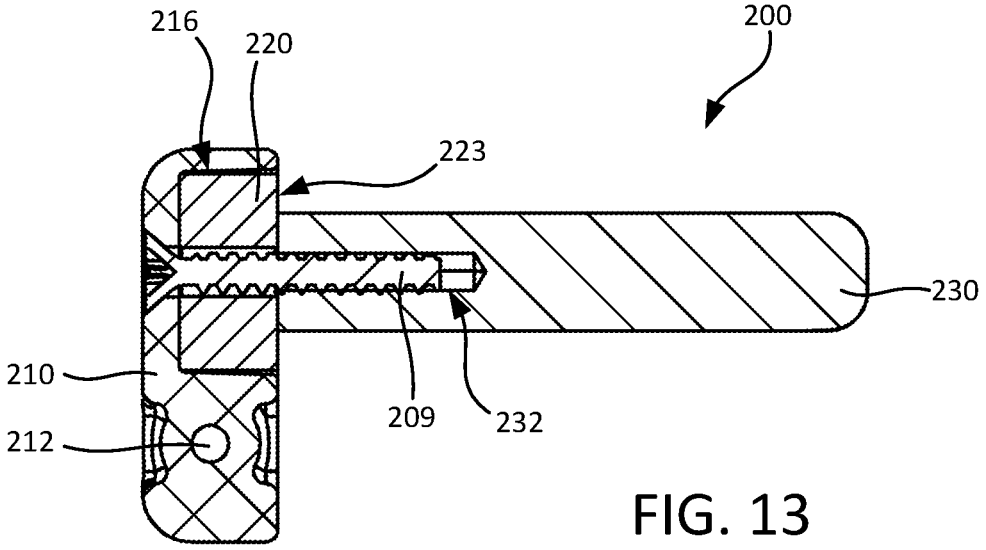
FIG. 13 illustrates a cross-sectional view of the magnet assembly of FIG. 9 taken along line A-A shown in FIG. 12.

One or both of first side panel 110 and/or second side panel 120 comprise a wedge protruding therefrom (e.g., protruding from a surface of the respective side panel). For example, as shown first side panel 110 comprises wedge 115. Relative to axis 50, wedge 115 begins at a first end more proximate breech end 150 of holster 100 and tapers inward (toward axis 50) to a second wedge end more proximate muzzle end 160 of holster 100. Wedge 115 (or a surface thereof) extends along a wedge axis 16. Wedge axis 16 and axis 50 as shown form an angle of between 5 and 30 degrees, or between 7 and 20 degrees, or between 10 and 15 degrees, or about 12 degrees. As shown in FIG. 8, second side panel 120 comprises a wedge 125 that is similar to or identical to edge 115. Wedge 125 is substantially a mirror image of wedge 115, so holster 100 can be used in left- and right-handed configurations.

Holster 100 with wedge 115 can provide various benefits. For example, in a configuration in which wedge 115 is disposed against the wearer's body (e.g., in an inside-waistband configuration), the wedge 115 and its angled surface can press into the wearer's body, creating friction with the wearer's body. With the weight of a firearm in holster 100, holster 100 can tend to sag downward when worn by a user. However, the shape of wedge 115 pushes against and may form an indentation in the wearer's body, and along with the friction caused with the wearer's body, the wedge can create an obstruction or resistance to such sagging. The same is true for wedge 125.

Additionally, in holster configurations comprising a center belt clip 190, the respective wedge (e.g., wedge 125) can provide greater gripping with center belt clip 190 of a belt or pant edge of a wearer. Center belt clip 190 comprises a base portion 192 and a clip portion 194 forward of base portion 192. Base portion 192 is coupled to the respective side panel (e.g., second side panel 120) aft of the respective wedge (e.g., wedge 125). First side panel 110 (and second side panel 120) can comprise respective coupling apertures 152, 154. Base portion 192 of center belt clip 190 can comprise coupling apertures in positions complementary to the positions of coupling apertures 152, 154, such that base portion 192 of center belt clip 190 can be attached to second side panel 120 by a fastener(s) 199 disposed through the coupling apertures of base portion 192 of center belt clip 190 and coupling apertures 152, 154 of second side panel 120. Fasteners 199 comprise threading that permit threading into end nuts 191. End nuts 191 can be positioned between coupling apertures 152, 154 and outer wall system 105, and/or with outer wall system 105.

Clip portion 194 of center belt clip 190 may not be coupled to second side panel 120, but can have a bias in a direction toward second side panel 120 and/or firearm cavity 90. Thus, clip portion 194 can be pulled away from second side panel 120 and/or firearm cavity 90, for example, to place a belt or pant edge of the wearer inside of clip portion 194, and in response to being released, clip portion 194 can return to its position proximate second side panel 120 to at least partially enclose the belt or pant edge of the wearer and couple holster 100 thereto. Wedge 125 protrudes into the space between clip portion 194 and second side panel 120, thus creating a greater tension and gripping force between clip portion 194 and second side panel 120 on the belt or pant edge of the wearer. At least a portion of wedge 125 protrudes into the belt or pant edge of the holster wearer to more securely fastening holster 100 to the wearer's clothing.

The wedge 115, 125 on a side panel can be a separate component coupled to an outer surface of the side panel. The wedge on a side panel can be part of the material of the side panel (e.g., the wedge is monolithic with other portions of the respective side panel). The protrusion of the wedge can form a larger area in that portion of the firearm cavity. For example, the protrusion of wedge 115 or wedge 125 can form a slide stop void in firearm cavity 90 that provides clearance for a slide stop of a firearm when positioned in firearm cavity 90.

A side panel 110, 120 comprises an attachment bulge protruding therefrom. For example, first side panel 110 comprises attachment bulge 113 and second side panel 120 comprises attachment bulge 123. The attachment bulge 113, 123 can be monolithic with the respective side panel 100, 120 and/or the respective wedge 115, 125. The attachment bulge 113, 123 can form a larger area in that portion of the firearm cavity 90 (such area is in communication (e.g., fluid communication) with the larger area of firearm cavity 90 formed by a wedge 115, 125), which can be configured to provide clearance for another part of the firearm or firearm plus anything coupled to the firearm. For example, the area in firearm cavity 90 formed by an attachment bulge 113, 123 can be configured to provide clearance for a release device of a rail attachment coupled to a firearm.

Clip portion 194 can comprise a hook 196 protruding inwardly from an inner surface of clip portion 194. Hook 196 can rest proximate or abutting second side panel 120, and the bias discussed above returns hook 196 to such position. Hook 196 can provide a forward boundary for a belt disposed between center belt clip 190 and second side panel 120, to prevent or mitigate the risk of holster 100 rising in response to an aft movement, such as drawing a firearm from holster 100.

Coupling apertures 152, 154 in side panels 110, 120 can comprise any suitable configuration or shape. For example, one of the coupling apertures can comprise a shape complementary to the cross-sectional shape of the fastener disposed therethrough (e.g., the shape of coupling aperture 152). As another example, one of the coupling apertures can comprise a shape larger than the cross-sectional shape of the fastener disposed therethrough, such that the fastener can be disposed within various portions of the coupling aperture. For example, top coupling aperture 154 in side panels 110, 120 comprises a shape larger than the cross-sectional shape of fasteners 199 (e.g., an elongated shape). Top coupling aperture 154 can span a length between breech end 150 and muzzle end 160 of holster 100, such that the respective fastener 199 can be disposed at a desired position between breech end 150 and muzzle end 160 of holster 100. Thus, the top end of base portion 192 of center belt clip 190 can be disposed more proximate to breech end 150 or muzzle end 160 of holster 100 as desired. Center belt clip 190 can rotate about the other coupling aperture (bottom coupling aperture 152) in response to moving the respective fastener 199 within bottom coupling aperture 154. The other coupling aperture (bottom coupling aperture 152) could comprise the larger shape such that center belt clip 190 could rotate about top coupling aperture 154. Utilizing this structure, the user can adjust the tilt of firearm cavity 90 and how the firearm disposed therein will rest on the user's belt or other clothing (e.g., by loosening fastener 199 in the elongated coupling aperture, positioning fastener 199 as desired, and tightening fastener 199 to maintain the desired position).

Holster 100 can comprise one or more outer belt clips 180. Outer belt clips 180 is configured to be disposed more proximate to top end 130 and/or bottom end 140 than a center belt clip 190 (e.g., above and/or below the wedge or guard panel). Outer belt clips 180 are coupled to outer wall system 105 (e.g., to first side panel 110 and/or second side panel 120). Outer belt clips are coupled to only one side panel of the outer wall 105 of holster 100. Outer belt clips 180 can be coupled to a side panel 110, 120 of the outer wall 105 without center belt clip 190 being coupled thereto, or center belt clip 190 can be coupled to a side panel 110, 120 of the outer wall 105 without outer belt clips 180 coupled thereto. For example, for an outside-waistband configuration (in which outer wall 105 is disposed outside of the user's waistband/belt), only center belt clip 190 (and not outer belt clips 180) may be coupled to a side panel of outer wall system 105. As another example, for an inside-waistband configuration (in which outer wall 105 is disposed inside the user's waistband/belt), only outer belt clips 180 (and not center belt clip 190) may be coupled to a side panel 110, 120 of outer wall 105.

Each outer belt clip 180 can comprise a base portion 186 and a clip portion 182 aft of base portion 186. Base portion 186 is coupled to the respective side panel (e.g., second side panel 120). Outer wall 105 can comprise coupling apertures 102 configured to facilitate coupling of outer belt clips 180 to outer wall system 105. Each side panel 110, 120 of outer wall 105 can comprise at least one set of coupling apertures 102. For example, first side panel 110 and second side panel 120 each comprise two sets of coupling apertures 102. An outer belt clip 180 couples to each set of coupling apertures 102. Each set of coupling apertures 102 is disposed in any suitable configuration or arrangement. For example, coupling apertures 102 can be arranged extending a length between muzzle end 160 and breech end 150 and/or a length between top end 130 and bottom end 140. Therefore, the user can select which coupling apertures 102 to utilize for each set of coupling apertures 102, such that the user can achieve a desired placement of the respective outer belt clip 180 in a muzzle-breech position and/or a top-bottom position. For example, coupling apertures 102 on holster 100 as shown are disposed in sets of four spanning a length between muzzle end 160 and breech end 150. Therefore, the user can dispose outer belt clips 180 at a desired position relative to muzzle end 160 and breech end 150, resulting in holster and the firearm therein sitting higher or lower on the user's belt or other clothing. Also, by choosing different positions within the respective coupling aperture 102 sets between the two outer belt clips 102, the user can achieve a desired tilt of firearm cavity 90 and how the firearm disposed therein will rest on the user's belt or other clothing about one of the outer belt clips 180 acting as a fulcrum.

Base portion 186 of outer belt clips 180 comprises coupling apertures 187, 188 in positions complementary to the positions of coupling apertures 102 in outer wall system 105, such that base portion 186 of outer belt clips 180 can be coupled to the respective side panel (first side panel 110 or second side panel 120) by a fastener(s) 189 being disposed through the coupling apertures 187, 188 of base portion 186 of outer belt clips 180 and coupling apertures 102 of second side panel 120. Fasteners 189 can comprise threading complementary to threading in end nuts 181, which are configured to receive and retain fasteners 189. End nuts 181 are positioned between coupling apertures 102 and outer wall system 105.

Clip portion 182 of outer belt clips 180 may not be coupled to second side panel 120, but can have a bias in a direction toward second side panel 120 and/or firearm cavity 90. Thus, clip portion 182 can be pulled away from side panel 120 and/or firearm cavity 90, for example, to place a belt or pant edge of the wearer within clip portion 182, and in response to being released, clip portion 182 can return to its position more proximate second side panel 120 to at least partially enclose the belt or pant edge of the wearer and couple holster 100 thereto.

Clip portion 182 can comprise a hook 184 protruding inwardly from an inner surface of clip portion 182. Hook 184 can rest proximate or abutting second side panel 120 or an inner portion of clip portion 182 (in examples, like outer belt clips 180, in which clip portion 182 clasps against itself), and the bias discussed above returns hook 184 to such position. Hook 184 can provide a forward boundary for a belt disposed in outer belt clips 180, to prevent or mitigate the risk of holster 100 rising in response to an aft movement, such as drawing a firearm from holster 100.

Coupling apertures 187, 188 in base portions 186 of outer belt clips 180 can be of any suitable configuration or shape. For example, one of the coupling apertures can comprise a shape complementary to the cross-sectional shape of the fastener disposed therethrough (e.g., the shape of coupling aperture 187). As another example, one of the coupling apertures can comprise a shape larger than the cross-sectional shape of the fastener disposed therethrough (e.g., an elongated shape), such that the fastener can be disposed within various portions of the coupling aperture. For example, aft coupling aperture 188 in base portions 186 can comprise a shape larger than the cross-sectional shape of fasteners 189. Aft coupling aperture 188 can span a length between top end 130 and top end 140 of holster 100, such that the respective fastener 189 can be disposed at a desired position within aft coupling aperture 188 between top end 130 and top end 140 of holster 100. Accordingly, a clip portion 182 of outer belt clips 180 can be disposed more proximate to top end 130 or top end 140 of holster 100 as desired. Outer belt clips 180 can rotate about the other coupling aperture (forward coupling aperture 187) in response to moving the respective fastener 189 within aft coupling aperture 188. The other coupling aperture (forward coupling aperture 187) could comprise the larger shape such that outer belt clips 180 could rotate about aft coupling aperture 188. In this manner, the user can adjust the tilt of firearm cavity 90 and how the firearm disposed therein will rest on the user's belt or other clothing.

Firearm cavity 90 can comprise one or more chambers. For example, firearm cavity 90 can comprise a main cavity 92 configured to house and retain the firearm barrel therein (and any other components around the barrel such as a slide, barrel shroud, ejector ride, and/or the like). The firearm barrel can be disposed below bridge 119 of outer wall system 105. Bridge 119 can form a sight channel 99 within firearm cavity 90. Sight channel 99 can be configured to provide clearance within outer wall system 105 and firearm cavity 90 for firearm sights protruding upward (e.g., sights on top of and/or above the firearm barrel).

Firearm cavity 90 can comprise an attachment cavity 94. Attachment cavity 94 can be in fluid communication with, and lower than, main cavity 92. Attachment cavity 94 can be configured to house a firearm attachment attached below the barrel (e.g., a rail attachment coupled below the barrel and/or forward of the trigger guard of the firearm, such as a light, a laser sight, and/or the like). Attachment cavity 94 can be in fluid communication with the area within firearm cavity 90 formed from and within attachment bulge 113. Via an attachment cavity 94, holster 100 can be compatible with firearms comprising rail attachments.

With additional reference to FIGS. 9-13, holster 100 can comprise a magnet assembly 200. Magnet assembly 200 can be configured to couple to a metal (e.g., steel) portion of the firearm disposed in holster 100 to retain the firearm in holster 100. For example, magnet assembly 200 can be coupled to muzzle end 160 of outer wall system 105 and holster 100. Magnet assembly 200 can comprise a magnet 220. Magnet 220 can be configured to attract and be in magnetic communication with a muzzle of a firearm disposed in firearm cavity 90 of holster 100. Magnet 220 can comprise any suitable shape, such as a circular, cylindrical, rectangular, square, cube, and/or the like. Magnet 220 can comprise a magnet inner surface 224 configured to face inwardly into firearm cavity 90. Magnet inner surface 224 can be configured to be in communication with a muzzle or crown of a firearm disposed in firearm cavity 90. Magnet inner surface 224 can be configured to be proximate and/or abutting the muzzle or crown of a firearm disposed in firearm cavity 90. In response to a firearm being disposed in holster 100 and properly seated with the muzzle or crown abutting magnet inner surface 224 and being in magnetic communication with magnet 220, an audible click sound can be produced indicating that the firearm is properly seated within holster 100.

Magnet assembly 200 can comprise a magnet housing 210 configured to couple to magnet 220 and hold magnet 220 in place. Magnet housing 210 can comprise a magnet recess 216. Magnet recess 216 can have a shape complementary to the shape of magnet 220, such that movement of magnet 220 within magnet recess 216 can be minimized or eliminated. Magnet 220 can be disposed at least partially within magnet recess 216. Magnet inner surface 224 can be substantially even with a top edge of magnet recess 216, or magnet inner surface 224 can be inside or outside of magnet recess 216 (e.g., forward or aft of the top edge of magnet recess 216).

Muzzle end 160 can comprise retention ledges 166 extending inwardly from the side panels of the outer wall system. Retention ledges 166 can be configured to at least partially retain magnet housing 210 in place between first side panel 110 and second side panel 120 and not travel in a forward direction and out of outer wall system 105.

Muzzle end 160 of outer wall system 105 can comprise a coupling device or system configured to couple magnet assembly 200 (and/or magnet housing 210) to outer wall system 105. Magnet assembly 200 (and/or magnet housing 210) can be coupled to and between first side panel 110 and second side panel 120. Magnet housing 210 can comprise a housing coupling device or system complementary to the coupling device/system of outer wall system 105 to facilitate coupling of muzzle end 160 to magnet housing 210.

The coupling device of muzzle end 160 of outer wall system 105 can comprise a coupling aperture (e.g., coupling aperture 162) disposed through outer wall system 105 at muzzle end 160. The coupling aperture in muzzle end 160 can be disposed through first side panel 110 and second side panel 120 such that the coupling apertures in each side panel are aligned. Magnet housing 210 can comprise a housing coupling aperture 212 disposed at a position complementary to coupling apertures 162 in first side panel 110 and second side panel 120 at muzzle end 160. Magnet housing 210 can be disposed within outer wall system 105 at muzzle end 160 and between first side panel 110 and second side panel 120. In response to magnet housing 210 being disposed between first side panel 110 and second side panel 120 in muzzle end 160, housing coupling aperture 212 can align with coupling aperture 162 in first side panel 110 and/or second side panel 120 and at least one fastener 169 (e.g., a screw, bolt, or any other suitable fastener) can be disposed therethrough to at least partially secure magnet housing 210 to muzzle end 160 of outer wall system 105. Two fasteners 169 can be disposed to couple magnet housing 210 to muzzle end 160 (e.g., one fastener through the coupling aperture 162 of each of first side panel 110 and second side panel 120).

The coupling device of muzzle end 160 of outer wall system 105 can comprise coupling aperture 164 disposed through outer wall system 105 at muzzle end 160. Coupling aperture 164 in muzzle end 160 can be disposed through first side panel 110 and second side panel 120 such that the coupling apertures in each side panel are aligned. Magnet housing 210 can comprise a housing coupling stud 214 protruding from a surface (e.g., a side surface proximate to and/or abutting first side panel 110 and/or second side panel 120) at a space complementary to coupling apertures 164 in first side panel 110 and second side panel 120 at muzzle end 160. Magnet housing 210 can be disposed within outer wall system 105 at muzzle end 160 and between first side panel 110 and second side panel 120. In response to magnet housing 210 being disposed between first side panel 110 and second side panel 120 in muzzle end 160, housing coupling stud 214 can align with coupling aperture 164 in first side panel 110 and/or second side panel 120, and coupling aperture(s) 164 can receive housing coupling stud 214 therein to at least partially couple magnet housing 210 to outer wall system 105. A housing coupling stud 214 can be comprised and protruding from opposite surfaces of magnet housing 210 such that housing coupling studs 214 are received by coupling apertures 164 on both sides of muzzle end 160 (through both of first side panel 110 and second side panel 120).

The coupling device of muzzle end 160 can comprise both coupling apertures 162, 164, and the housing coupling device can comprise both coupling aperture 212 and coupling stud 214, on one or both sides of each.

The magnet of a magnet assembly can be directly coupled to muzzle end 160 of outer wall assembly 160, for example, by the magnet comprising the coupling device(s) discussed herein with regard to magnet housing 210 (e.g., magnet can comprise coupling apertures and/or coupling studs complementary to coupling apertures of outer wall system 105). Thus, a magnet can couple directly to outer wall system 105 (e.g., if the magnet assembly does not comprise a magnet housing or the like).

Magnet assembly 200 can further comprise a stabilizer rod 230. Stabilizer rod 230 can be coupled to magnet 220 and/or magnet housing 210. Stabilizer rod 230 can extend inwardly into firearm cavity 90, for example, along an axis along which a firearm barrel bore will extend in response to the firearm being disposed in firearm cavity 90 (e.g., axis 50). Stabilizer rod 230 can be configured to be disposed within a bore of a firearm in response to the firearm being disposed within firearm cavity 90 to stabilize the firearm within holster 100. That is, in response to a firearm being inserted into firearm cavity 90, stabilizer rod 230 can be inserted into the firearm bore and rest therein in response to the firearm being seated in holster 100 (e.g., with the muzzle or crown being disposed proximate or abutting magnet 220).

Stabilizer rod 230 can comprise any suitable cross-sectional shape. For example, stabilizer rod 230 can comprise a circular cross-sectional shape complementary to a barrel bore. As another example, stabilizer rod 230 can comprise a square, triangular, rectangular, or any other geometric cross-sectional shape having at least one dimension complementary to a barrel bore (e.g., the corners of a shape can be configured to contact the surface of the firearm bore). Stabilizer rod 230 can comprise a cross-sectional dimension complementary to a certain firearm caliber. Stabilizer rod 230 can comprise rifling edges 233, which can be complementary to the rifling of a firearm to be disposed within holster 100. Thus, rifling edges 233 can be positioned within the complementary rifling in the barrel of the firearm to further stabilize the firearm.

Stabilizer rod 230 and magnet 220 can comprise center points along a common axis (e.g., center axis 204 shown in FIG. 8). Stabilizer rod 230 can couple to magnet 220 (e.g., with a forward surface pf stabilizer rod 230 proximate or abutting magnet inner surface 224) such that a portion 223 of magnet inner surface 224 is radially outward of stabilizer rod 230 relative to common axis 204. Such radially outward portion 223 of magnet inner surface 224 can be exposed and/or configured to be proximate and/or abutting the crown of a firearm barrel disposed in holster 100. Magnet recess 216 can comprise a center point along the same common axis of stabilizer rod 230 and magnet 220.

Magnet assembly 200 can comprise a fastener 209 disposed through and coupling magnet housing 210, magnet 220, and/or stabilizer rod 230. Magnet housing 210 can comprise a coupling aperture 217 disposed therethrough (e.g., through magnet recess 216), and magnet 220 can comprise magnet coupling aperture 222 disposed therethrough. Fastener 209 can be disposed such coupling aperture through magnet housing 210 and magnet coupling aperture 222. Stabilizer rod 230 can comprise a coupling void 232 configured to receive an end of fastener 209 to couple magnet housing 210, magnet 220, and/or stabilizer rod 230 together. Fastener 209 can comprise threading, and coupling void 232 of stabilizer rod 230 can comprise complementary threading to receive the threaded fastener 209.

Use of magnet 220 and/or stabilizer rod 230 can help retain a firearm disposed in holster 100 in place in a desired position (e.g., keeping the firearm bore along a desired axis within holster 100). For example, with holster 100 having attachment cavity 94, if using holster 100 for a firearm without a rail attachment coupled thereto, without magnet 220 and/or stabilizer rod 230, the firearm may shift or wiggle within firearm cavity 90 with attachment cavity being empty. Thus, magnet 220 and/or stabilizer rod 230 allow better stabilization within holster 100 for any firearm, with or without a rail attachment or other features (or firearms for which holster 100 may not be specifically designed or fitted).

Holster 100 can comprise a spacer assembly 170. Spacer assembly 170 can be configured to allow the user to select and achieve a desired resting angle of holster 100 and firearm cavity 90. The resting angle can be, for example, between the holster (or axis 50 defining holster 100 and/or the axis along which a firearm will rest in holster 100) and a vertical axis spanning in the direction of gravity (a gravitational direction straight down). Thus, spacer assembly 170 can be configured to allow adjustment along curved line 45 (shown in FIGS. 4 and 5) to change the resting angle of holster. Adjustment along curved line 45 can cause holster 100 and/or outer wall system 105 to press more or less against the body of a holster wearer.

Spacer assembly 170 can be comprised at top end 130 and/or bottom end 140 of holster 100. For example, with outer wall system 105 and its first and second side panels 110, 120 being one piece of material, fasteners can couple first and second side panels 110 at top end 130 or bottom end 140. In holster 100, fasteners 109 couple first and second side panels 110 at bottom end 140 through bottom end coupling apertures 103. Fasteners 109 can couple spacer assembly 170 to outer wall system 105.

Spacer assembly 170 can comprise a spacer body 171 spanning between a spacer base end 174 and a spacer adjustment end 178. Spacer base end 174 can comprise one or more coupling apertures 173 configured to receive a fastener and couple spacer body 171 to outer wall system 105 of holster 100. For example, coupling apertures 173 of spacer body 171 can be disposed in positions complementary to positions of coupling apertures 103 at bottom end 140 of outer wall system 105. Coupling apertures 103 at bottom end 140 can be arranged in a set (similar to the sets of coupling apertures 102), for example, spanning a length between muzzle end 160 and breech end 150 of holster 100. Accordingly, a user can align spacer coupling apertures 173 at a desired position along coupling apertures 103 to establish a desired position of spacer body 171 between muzzle end 160 and breech end 150 of holster 100.

Spacer adjustment end 178 of spacer body 171 can comprise an adjustment aperture 172 disposed therethrough. Adjustment aperture 172 can span a length of adjustment end 178 and allow movement and coupling of a fastener at any desired position along such length. Accordingly, spacer shim 175 can couple to spacer adjustment end 178 by fastener 179 being disposed through spacer shim 175 and adjustment aperture 172 (e.g., and secured via end nut 177 coupling to fastener 179 on the other side of spacer body 171). Further, by loosening fastener 179 and translating fastener within adjustment aperture 172, the position of spacer shim 175 can be determined along the length of adjustment aperture 172 between muzzle end 160 and breech end 150 of holster 100. At the selected position, fastener 179 can be tightened to hold spacer shim 175 in place at such position. Adjustment aperture 172 having a shape larger than the cross-sectional shape of fastener 179 (adjustment apertured 172 being elongated), and a coupling aperture of adjustment shim 175 through which fastener 179 is disposed having a shape complementary to the cross-sectional shape of fastener 179, can facilitate such movement/adjustment of the position of spacer shim 175. This further allows the holster user to adjust where spacer shim 175 can contact the user body.

Spacer shim 175 can be configured to press against the holster user's body to maintain a certain position of holster 100 and a desired resting angle. To adjust how holster 100 and/or axis 50 rests along curved line 45, multiple spacer shims 175 can be stacked on one another in a direction similar to the direction between first side panel 110 and second side panel 120. The stack of spacer shims 175 can be coupled by fastener 179, as discussed herein with regard to a single spacer shim 175. Thus, with specific reference to FIGS. 4 and 5, to cause axis 50 to move along curved line 45 in a direction toward first side panel 110, more spacer shims 175 can be stacked and coupled to spacer body 171 as discussed herein. The greater number of spacer shims 175 can press more greatly on the holster user's body (which would be more proximate second side panel 120, opposite first side panel 110), and tilt holster 100 and axis 50 away from user's body. To decrease the tilt away from the user's body (e.g., and cause axis 50 to be closer to vertical), fewer or no spacer shims 175 can be used in spacer assembly 170. Spacer assembly 170 can be removed from holster 100 if such adjustments are not desired.

Each spacer shim 175 can have any suitable thickness, such as between about 0.1 and 0.2 inch, allowing incremental adjustment of the resting angle. Spacer assembly 170 can comprise spacer shims 175 that are similar or substantially identical to one another. Spacer assembly 170 can comprise an outer spacer shim 175 configured to be the outermost spacer shim 175 that rests against the user's body. The outer spacer shim can comprise an outer surface 176, which can comprise texturing or another gripping structure configured to create friction with the user and hold the spacer shims 175 in place against the user. Other spacer shims 175 in a shim stack can have substantially smooth or nontextured surfaces.

Spacer body 171 can comprise any suitable shape spanning between spacer base end 174 and spacer adjustment end 178. For example, spacer body 171 can be linear, nonlinear, angled, curved, and/or the like. Spacer adjustment end 178 can be disposed along an axis different than spacer base end 174. For example, spacer adjustment end 178 can be disposed further from firearm cavity 90 than spacer base end 174. As another example, spacer adjustment end 178 can be disposed further from firearm cavity 90 than spacer base end 174. As another example, with first side panel 110 and second side panel 120 being aligned with one another, at least a portion of spacer adjustment end 178 of spacer body 171 can be misaligned with first side panel 110 and second side panel 120, while all or most of spacer base end 174 can be aligned with first side panel 110 and second side panel 120. Such configurations can allow the ability of spacer adjustment end 178 to better be able to bend and/or contact the user's body, tilting axis 50 along curved line 45 more readily than spacer body 171 having a linear configuration.

Spacer assembly 170 can be switched to either side of outer wall system 105 depending on the configuration the user wishes to utilize (e.g., between lefthanded or right-handed configurations).

As discussed herein, any component, configuration, or aspect of, or coupled to, one side panel of an outer wall system of a holster can be applied to the other side panel (e.g., both side panels being, or being capable of being, mirror images of one another). Also, reference to a "fastener" as used herein can comprise any suitable fastener, such as a screw, bolt, nail, clip, hook, pin, rivet, and/or the like. The holster systems discussed herein allow desired retention of a firearm and adjustability in multiple directions and areas to allow a user to achieve a desired fit, comfort, and firearm resting position with the holster.

The detailed description herein is presented for purposes of illustration only and not of limitation. For example, the steps recited in any of the method or process descriptions may be executed in any combination and/or order and are not necessarily limited to the order or combination presented. Furthermore, any reference to singular includes plural examples, and any reference to more than one component or step may include a singular component or step. Also, any reference to attached, fixed, connected, or the like may include permanent, removable, temporary, partial, full, and/or any other possible attachment option. Additionally, any reference to without contact (or similar phrases) may also include reduced contact or minimal contact.

All ranges may include the upper and lower values, and all ranges and ratio limits disclosed herein may be combined. Unless specifically stated otherwise, references to "a," "an," and/or "the" may include one or more than one and that reference to an item in the singular may also include the item in the plural. Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item. Further, reference to, e.g., a "first" item and a "second" item does not mean that there are no intervening items, and such intervening items may be present.

Systems, methods and apparatus are provided herein. In the detailed description herein, references to "one example", "an example", "various examples", etc., indicate that the example described may include a particular feature, structure, or characteristic, but every example may not necessarily include the particular feature, structure, or characteristic. Moreover, when a particular feature, structure, or characteristic is described in connection with an example, it is within the knowledge of one skilled in the art to affect such feature, structure, or characteristic in connection with other examples whether or not explicitly described. After reading the description, it will be apparent to one skilled in the relevant art(s) how to implement the disclosure in the examples herein.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A firearm holster comprising:

(a) an outer wall defining a cavity configured to receive a firearm, wherein the outer wall has a muzzle end configured to house a muzzle of the firearm and a breech end; and (b) a magnet assembly coupled to the muzzle end, wherein the magnet assembly comprises a magnet housing coupled to the outer wall, a magnet coupled to the magnet housing, and a fastener connecting the magnet housing and the magnet, wherein the magnet housing comprises a housing coupling aperture, and the magnet comprises a magnet coupling aperture, wherein the housing coupling aperture and the magnet coupling aperture are disposed along a common axis, wherein the fastener couples the magnet housing and the magnet along the common axis, wherein the magnet is positioned at least partially in a muzzle end of the cavity and is configured to be in magnetic communication with a crown of the muzzle of the firearm when the firearm is positioned in the cavity, and wherein the common axis spans along a bore of the firearm when the firearm is positioned in the cavity.

2. The firearm holster of claim 1, wherein the magnet assembly further comprises a stabilizer rod coupled to the magnet housing and the magnet and spanning along the common axis, wherein the stabilizer rod is positioned at least partially in the cavity and is configured to be disposed within the bore of the firearm when the firearm is positioned in the cavity.

3. The firearm holster of claim 1, wherein the magnet housing comprises a magnet recess, and the magnet is positioned at least partially within the magnet recess, wherein the magnet recess spans along the common axis.

4. The firearm holster of claim 1, wherein the magnet comprises a magnet inner surface configured to touch the crown of the muzzle of the firearm when the firearm is positioned in the cavity.

5. The firearm holster of claim 2, wherein the stabilizer rod comprises a coupling void disposed along the common axis configured to receive the fastener therein, wherein the fastener couples the stabilizer rod to the magnet housing and the magnet along the common axis.

6. The firearm holster of claim 1, wherein the muzzle end of the outer wall comprises a muzzle-end coupling device, and the magnet housing comprises a housing coupling device connected to the muzzle-end coupling device.

7. The firearm holster of claim 6, wherein the muzzle-end coupling device comprises a wall coupling aperture disposed through the outer wall, and wherein the housing coupling device comprises a housing coupling stud protruding from a surface of the magnet housing, wherein the wall coupling aperture of the outer wall is configured to receive the housing coupling stud to couple the magnet housing to the outer wall.

8. A firearm holster comprising:

an outer wall defining a cavity configured to receive a firearm, wherein the outer wall comprises a first side panel and a second side panel opposite the first side panel, wherein the cavity is configured to receive the firearm along a longitudinal holster axis, and wherein at least one of the first side panel and the second side panel comprises a protruding wedge, wherein the protruding wedge comprises a surface spanning along a wedge axis that is formed at an angle of between 5 and 15 degrees between the longitudinal holster axis and the wedge axis; and a belt clip coupled to the at least one of the first side panel and the second side panel, such that the protruding wedge protrudes into a space under the belt clip.

9. The firearm holster of claim 8, wherein the wedge is connected to or integrally formed with the first side panel and/or the second side panel.

10. The firearm holster of claim 8, wherein the first side panel comprises the wedge and the second side panel comprises a second wedge.

11. The firearm holster of claim 8, wherein the wedge forms a slide stop void in the cavity, wherein the slide stop void is configured to provide clearance for a slide stop of the firearm when the firearm is positioned in the cavity.

12. The firearm holster of claim 11, wherein the at least one of the first side panel and the second side panel further comprises an attachment bulge, wherein the attachment bulge forms an attachment release void in the firearm cavity, and the attachment release void is configured to provide clearance for a release device of a rail attachment coupled to the firearm.

13. The firearm holster of claim 8, wherein the cavity is further configured to receive a rail attachment coupled to the firearm when the firearm is positioned in the firearm cavity.

14. A firearm holster, comprising:

an outer wall defining a cavity configured to receive a firearm along a longitudinal holster axis; and a spacer assembly coupled to the outer wall, wherein the spacer assembly comprises a spacer body, extending between a spacer base end and a spacer adjustment end comprising an adjustment aperture, and a spacer shim coupled to the adjustment end via the adjustment aperture, wherein the spacer adjustment end and the spacer shim are configured to press against a body of a holster wearer to achieve a desired resting angle of the holster, wherein the resting angle is an angle between the longitudinal holster axis of the firearm holster and the body of the holster wearer to cause the longitudinal holster axis to be tilted closer to, or farther away from, the body of the holster wearer.

15. The firearm holster of claim 14, wherein the outer wall comprises a first side panel and a second side panel opposite the first side panel, wherein the first side panel and the second side panel are coupled at a bottom end of the firearm holster, and wherein the spacer base end of the spacer body is coupled to the bottom end.

16. The firearm holster of claim 14, wherein the spacer adjustment end of the spacer body extends along a first axis, the spacer base end extends along a second axis, and the first axis is different from the second axis.

17. The firearm holster of claim 15, wherein the spacer adjustment end is disposed further from the firearm cavity than the spacer base end.

18. The firearm holster of claim 14, further comprising a plurality of spacer shims stacked and coupled to the spacer adjustment end of the spacer body via the adjustment aperture, wherein the plurality of spacer shims is configured to achieve the desired resting angle of the holster.

19. The firearm holster of claim 18, wherein the plurality of spacer shims comprises an outer shim, wherein the outer shim comprises an outer surface configured to contact and create a gripping force with the body of the holster user.

20. The firearm holster of claim 1, wherein the stabilizer rod comprises at least one rifling edge which is complementary to rifling of the firearm to be disposed in the cavity.

* * * * *